US008020605B2

(12) United States Patent
Shutts et al.

(10) Patent No.: US 8,020,605 B2
(45) Date of Patent: Sep. 20, 2011

(54) CONTINUOUS STEEL SLAB CASTER AND METHODS USING SAME

(75) Inventors: Adam J. Shutts, Dyersburg, TN (US); John Carlton Elinburg, II, Jonesboro, AR (US); Jonathon David Otts, Blytheville, AR (US); George Gurley, Kennett, MO (US); David Walton Parsley, Portageville, MO (US)

(73) Assignee: Nucor Corporation, Charlotte, NC (US)

( * ) Notice: Subject to any disclaimer, the term of this patent is extended or adjusted under 35 U.S.C. 154(b) by 439 days.

(21) Appl. No.: 12/263,299

(22) Filed: Oct. 31, 2008
(Under 37 CFR 1.47)

(65) Prior Publication Data

US 2009/0250188 A1 Oct. 8, 2009

Related U.S. Application Data

(63) Continuation-in-part of application No. 11/627,511, filed on Jan. 26, 2007, now abandoned.

(51) Int. Cl.
*B22D 11/16* (2006.01)

(52) U.S. Cl. ..... 164/491; 164/452; 164/154.5; 164/154.8; 164/436

(58) Field of Classification Search ..... 164/154.5, 164/154.8, 436, 452, 491; 73/1.15
See application file for complete search history.

(56) References Cited

U.S. PATENT DOCUMENTS

| | | | | |
|---|---|---|---|---|
| 4,237,959 | A | 12/1980 | Yamamoto et al. | |
| 4,356,860 | A | 11/1982 | Gladwin | |
| 4,420,029 | A | 12/1983 | Kameyama et al. | |
| 4,945,975 | A | 8/1990 | Sorimachi et al. | |
| 5,265,665 | A | 11/1993 | Fujii et al. | |
| 5,279,354 | A | 1/1994 | Grove | |
| 5,871,040 | A | 2/1999 | Kaseda et al. | |
| 5,913,357 | A | 6/1999 | Hanazaki et al. | |
| 6,142,212 | A * | 11/2000 | Scholz et al. | 164/452 |
| 6,568,461 | B1 | 5/2003 | Pleschiutschnigg | |
| 2002/0096308 | A1 | 7/2002 | Sasai et al. | |
| 2004/0182539 | A1 | 9/2004 | Yamane et al. | |

FOREIGN PATENT DOCUMENTS

| | | | |
|---|---|---|---|
| JP | 02290656 A | | 11/1990 |
| JP | 08047762 A | * | 2/1996 |
| JP | 2000079447 A | * | 3/2000 |
| KR | 20000039134 A | | 7/2000 |

OTHER PUBLICATIONS

JPO machine translation of JP 08047762 A, Feb. 20, 1996.*
JPO machine translation of JP 2000079447 A, Mar. 21, 2000.*

(Continued)

*Primary Examiner* — Jessica L Ward
*Assistant Examiner* — Kevin E Yoon
(74) *Attorney, Agent, or Firm* — Hahn Loeser & Parks LLP

(57) ABSTRACT

A steel slab caster having a mold with movable opposing mold faces, and methods of using the steel slab caster for casting steel slabs. The movable opposing mold faces may be laterally positioned with respect to each other in a predefined configuration. Molten steel may be introduced into the mold of the slab caster. The forces exerted by the molten metal on at least one of the opposing mold faces and/or the lateral positions of the opposing mold faces may be monitored during casting at locations on at least one of the movable mold faces. The position of the monitored mold face may be controlled during casting responsive to the monitored forces and/or monitored position.

20 Claims, 5 Drawing Sheets

OTHER PUBLICATIONS

"Slab Casting Progress: Thick, Thin and Strip, Metal Producing & Processing," Jan./Feb. 2002, pp. 18-20.
TTP By-Wire Box, "Automotive Control Solution for Brushless DC Motors," TTTech Computertechnik AG, 2005, pp. 1-13.
Written Opinion of the International Search Report received in International Application No. PCT/US08/50245 mailed on May 22, 2008.
International Search Report received in International Application No. PCT/US08150245 mailed on May 22, 2008.

* cited by examiner

CONTINUOUS STEEL SLAB CASTER AND METHODS USING SAME

RELATED APPLICATIONS

This application is a continuation-in-part of application Ser. No. 11/627,511, filed Jan. 26, 2007, now abandoned, which is hereby incorporated by reference.

BACKGROUND AND SUMMARY

In the continuous slab casting of steel, molten (liquid) steel from a steelmaking ladle is poured indirectly into a casting mold and cast into semi-finished shapes (slabs, blooms, and billets). The semi-finished shape is determined by the casting machine mold that receives the molten steel from a tundish and casts the steel into a steel strand with a molten inner core and an outer surface solidified by cooling as the strand moves downwardly through the mold. The strand is further subjected to secondary cooling upon exiting from the mold until, the entire strand is solidified. The strand is then cut to a desired length.

In the continuous caster, the molten steel, or melt, from the tundish usually flows into the mold through a shroud and submerged entry nozzle (SEN), which is connected to the outlet of the tundish. The SEN discharges the molten metal into the mold to a selected depth below the surface (the "meniscus") of the melt in the mold. The flow of the molten melt from the tundish is gravity fed by the pressure difference between the liquid levels of the tundish and that of the melt in the mold. The melt flow from the tundish may be controlled by a stopper rod that at least partially blocks the exit port to the shroud, or a slide gate that moves across the outlet port of the tundish to the shroud. As the molten metal enters the mold, the steel solidifies at the water cooled mold walls to form a shell, which is continuously withdrawn at the casting speed to produce the steel strand by oscillation of the mold walls.

In such a continuous slab casting process, the flow of the molten steel into the mold can affect the quality of the cast steel. Since the outlets of the SEN are below the liquid level in the mold, turbulence and other transient changes in the molten steel produce oxide inclusions and gas bubbles, and flow velocities may entrain droplets of molten slag in the cast strand. Also, foreign particles trapped at the meniscus can similarly be entrained in the cast strand and generate surface defects and surface cracks. All of these produce defects in the cast strand, and result in rejection of the product and loss of manufacturing efficiency.

The width of the steel strand exiting the mold is determined substantially by the relative separation and taper angle of opposing faces of the mold. The molten steel in the mold tends to shrink (i.e., pull away from the mold faces) due to cooling as it moves from the top of the mold (e.g., adjacent the SEN) to the bottom exit of the mold. The mold faces are tapered to account for the shrinkage, so that the molten steel moving through the mold may maintain contact with the mold faces. However, this has proved difficult with different steel compositions processed through the same continuous slab caster, which cool at different rates, even with moveable mold walls. Too much taper may increase incidence of surface defects such as longitudinal and transverse cracking and crinkling of the shell, whereas too little taper may enable the shell to bulge. Excessive bulge may cause a breakout in the shell. Control of the mold face reduces product defects, mold damage and breakouts.

A method of continuously casting steel slabs is disclosed for improved control of the mold faces and the melt as the strand moves through the casting mold. The method of continuously casting steel slabs may include steps of

- assembling a casting mold for continuous casting of steel slabs comprising a set of laterally movable opposing mold faces;
- introducing molten metal into the casting mold;
- monitoring the lateral positions of at least one of the opposing mold faces in two vertically spaced locations along the monitored mold face during casting and producing electrical signals indicative of the lateral position of the mold face at the vertically spaced locations;
- controlling the position of the monitored mold face at the vertically spaced locations during casting responsive to the electrical signals indicative of the lateral positions of the mold face.

The method may further comprise monitoring the lateral positions on each of the opposing mold faces in the set in two vertically spaced locations along the mold faces during casting; and controlling the position of each mold face at the vertically spaced locations during casting responsive to the electrical signals indicative of the lateral positions of the mold face.

Alternately, the method of continuously casting steel slabs may include the steps of:

- positioning at least one set of laterally movable opposing mold faces of a casting mold with respect to each other in a predefined lateral configuration;
- introducing molten metal into the casting mold;
- monitoring the lateral positions of each of the opposing mold faces in at least one location along the monitored mold face during casting and producing electrical signals indicative of the lateral positions of the mold faces;
- controlling the position of the monitored mold face during casting responsive to the electrical signals indicative of the lateral positions of the mold faces.

The method may include automatically adjusting the mold faces during casting to maintain the predefined lateral configuration. Additionally, the predefined lateral configuration may include at least one of a distance set point and a taper set point between the opposing mold faces.

Controlling the position of the monitored mold face may include adjusting lateral positions of the opposing mold faces during casting to maintain at least one of a distance set point and a taper set point between said opposing mold faces. Adjusting the lateral positions of the mold faces may be accomplished using at least one actuator selected from the group consisting of hydraulic drives, electrical drives, and mechanical drives and capable of moving the mold face at the vertically spaced locations during casting as desired. Monitoring of the lateral positions may be accomplished using at least one position sensor selected from the group consisting of temposonic transducers, magnetostrictive position sensors, and linear position sensors. Controlling the position of the monitored mold face may be performed automatically or manually.

The method of continuously casting steel slabs may further comprise directing the metal exiting the mold into a support roller assembly, the metal continuing to solidify into a solid metal strand having a width dimension substantially defined by the opposing mold faces, and cutting the solid metal strand across the width dimension to form a solid steel slab having a predetermined length.

In an alternate method of continuously casting steel slabs, the method may include assembling a casting mold for continuous casting of steel slabs comprising a set of laterally movable opposing mold faces;

introducing molten metal into the casting mold;

monitoring the forces exerted by the molten metal on at least one of the opposing mold faces in two vertically spaced locations along the monitored mold face during casting and producing electrical signals indicative of the forces exerted on the mold face;

controlling the position of the monitored mold face at the vertically spaced locations during casting responsive to the electrical signals indicative of the forces exerted on the mold face.

The method may further include monitoring the forces on each of the opposing mold faces in the set in two vertically spaced locations along the mold faces during casting; and controlling the position of each mold face at the vertically spaced locations during casting responsive to the electrical signals indicative of the forces exerted on the mold face.

The position of the monitored mold face may be controlled by adjusting lateral positions of the opposing mold faces during casting to maintain a desired force exerted on the mold face. The monitoring of forces may be accomplished using load cells. In one alternate, at least one load cell is in the form of a clevis pin operatively connecting the mold face and an actuator capable of controlling the position of the mold face at one or more vertically spaced locations during casting as desired. Alternately, the load cells may be integrated with actuators capable of controlling the position of the mold faces during casting as desired.

A continuous steel slab caster is disclosed having an oscillatable slab caster mold capable of receiving molten steel comprising a set of laterally movable opposing mold faces;

at least two position sensors positioned capable of monitoring the lateral positions of at least one of the opposing mold faces in two vertically spaced locations along the monitored mold face during casting and producing electrical signals indicative of the lateral position of the mold face at the vertically spaced locations; and actuators capable of controlling the position of the monitored mold face at the vertically spaced locations during casting responsive to the electrical signals indicative of the lateral positions of the mold face.

The steel slab caster may further include a feedback controller and drive assembly capable of causing the actuators to adjust lateral positions of the opposing mold faces during casting responsive to the electrical signals indicative of the lateral position of the mold face in the vertically spaced locations to maintain at least one of a distance set point and a taper set point between the opposing mold faces.

The position sensors may include at least one sensor selected from the group consisting of temposonic transducers, magnetostrictive position sensors, and linear position sensors, and the actuators may include at least one selected from the group consisting of hydraulic drives, electrical drives, or mechanical drives. The opposing movable mold faces may be the narrow faces of the mold.

Alternately, the continuous steel slab caster may include:

an oscillatable slab caster mold capable of receiving molten steel comprising a set of laterally movable opposing mold faces;

force sensors positioned capable of monitoring the forces exerted by the molten metal on at least one of the opposing mold faces in two vertically spaced locations along the monitored mold face during casting and producing electrical signals indicative of the forces exerted on the mold face; and actuators capable of controlling the position of the monitored mold face at the vertically spaced locations during casting responsive to the electrical signals indicative of the forces exerted on the mold face.

The slab caster may include a feedback controller and drive assembly capable of causing the actuators to adjust lateral positions of the opposing mold faces responsive to the electrical signals indicative of the forces exerted on the mold face during casting to maintain a desired force.

The force sensors may be load cells. Additionally, the load cells may be in the form of clevis pins positioned between the opposing movable mold faces and the actuators.

The method of continuously casting steel slabs disclosed is more reliable in maintaining contact between the mold faces and the melt as the strand moves through the casting mold.

The method of continuously casting steel slabs may include adjusting the lateral positions of the opposing mold faces in response to generated data to maintain a distance set point or a taper set point, or both, between the opposing mold faces as casting proceeds. In accordance with an embodiment of the present invention, the adjusting of the lateral position of the opposing mold faces is performed automatically.

The monitoring of the lateral positions of the opposing mold faces may be accomplished in at least two vertically spaced locations along both mold moveable faces as casting proceeds. The adjusting of the lateral positions of the opposing moveable mold faces is performed in response to generated data to maintain distance set points between corresponding laterally positioned locations on the opposing mold faces, or to maintain a taper set point of each of the opposing mold faces, or both as casting proceeds.

Adjusting of the opposing mold faces may be accomplished, either manually by an operator or automatically, employing hydraulic, electrical, or mechanical drives, in accordance with a desired embodiment of the present invention. The opposing moveable mold faces may be the narrow faces of the mold. Alternatively, the opposing moveable mold faces may be the broad faces of the mold.

In any case, the monitoring of the positions of the opposing mold faces may be accomplished using at least one of temposonic transducers, magnetostrictive position sensors, or linear position sensors positioned on the mold wall, or on the drive assembly. As a back up, or in the alternative, the sensors may sense the temperature of the cooling water flowing through the mold adjacent the particular mold face location, which decreases as molten metal moves away from the mold face. Such temperature sensing may be used to give a course indication of whether or not the mold faces are properly positioned.

Alternatively or in addition, the sensors may measure the pressures exerted by the molten metal against the mold face, to measure when the surface of the molten metal moves away from the mold face.

In yet another alternate, the continuous steel slab caster may include the following elements:

(a) an oscillatable slab caster mold capable of receiving molten steel and having at least one set of opposing movable mold faces;

(b) at least two sensors adjacent at least one face of the opposing moveable mold faces at vertically spaced locations along the mold face, with each sensor capable of monitoring a lateral position of the adjacent mold face and/or the pressure exerted by the molten metal against the adjacent mold face at the locations, and generating corresponding position and/or pressure data as casting proceeds; and (c) positioning devices capable of adjusting the opposed movable mold faces in response to the generated data from the vertically spaced locations.

The steel slab caster may further comprise a feedback controller and drive assembly. The feed back controller is capable of actuating the drive assembly to automatically adjust the lateral position of the opposing movable mold faces in response to the generated data, to maintain a relative distance set point between the opposing mold faces and/or to maintain a taper set point of each of the opposing mold faces as casting proceeds. In accordance with an embodiment of the present invention, the at least one set of opposing moveable mold faces are the narrow faces of the mold.

The sensors may be temposonic transducers, magnetostrictive position sensors, and/or linear position sensors. As a back up, or in the alternative, the sensors may sense the cooling water temperature circulated through the mold adjacent the particular mold face location, which increases as molten metal move away from the mold face.

Alternatively, the method of continuously casting steel slabs may include the following steps:

laterally positioning at least one set of movable opposing mold faces of a slab caster mold with respect to each other in a predefined lateral configuration;

introducing molten steel into the slab caster mold having the at least one set of opposing mold faces;

monitoring the lateral positions of the opposing mold faces and/or pressures exerted by the molten steel against the mold faces in at least two vertically spaced locations on each movable mold face of the opposing mold faces as casting proceeds;

generating data in response to the monitoring; and adjusting the opposed movable mold faces in response to the generated data at the vertically spaced locations.

The method of continuously casting steel slabs may further include automatically adjusting at least one of the lateral positions of the opposing mold faces in response to the generated data to maintain the predefined lateral configuration. In accordance with an embodiment of the present invention, the predefined lateral configuration includes a set point relative distance between the opposing mold faces and/or a set point taper angle of each of the opposing mold faces.

The monitoring may be accomplished using temposonic transducers, magnetostrictive position sensors, and/or linear position sensors. The adjusting may be accomplished using hydraulic, electrical, or mechanical drives, and the opposing moveable mold faces may be the narrow faces of the mold.

The method of continuously casting steel slabs further includes directing the molten steel to exit the mold into a support roller assembly such that the molten steel continues to harden into a solid metal strand having a width dimension substantially defined by the distance between the opposing mold faces at the mold exit. The metal strand may be cut across the width dimension to form solid steel slabs of a predetermined length.

These and other advantages and novel features of the present invention, as well as details of illustrated embodiments thereof, will be more fully understood from the following description and drawings.

DETAILED DESCRIPTION OF THE DRAWINGS

Figure 1:
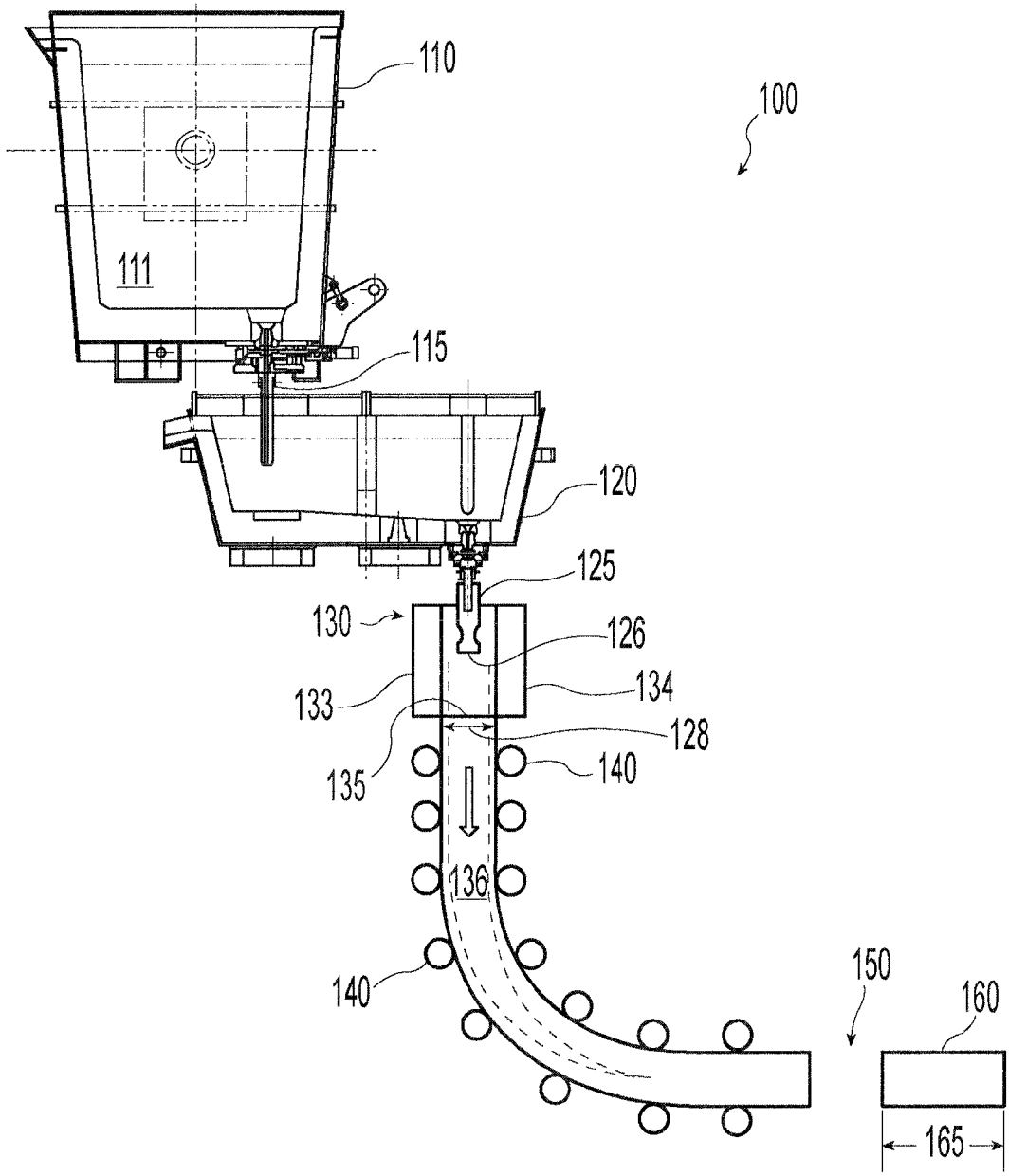
FIG. 1 is a schematic drawing illustrating a steel slab caster having a caster mold.
Figure 2:
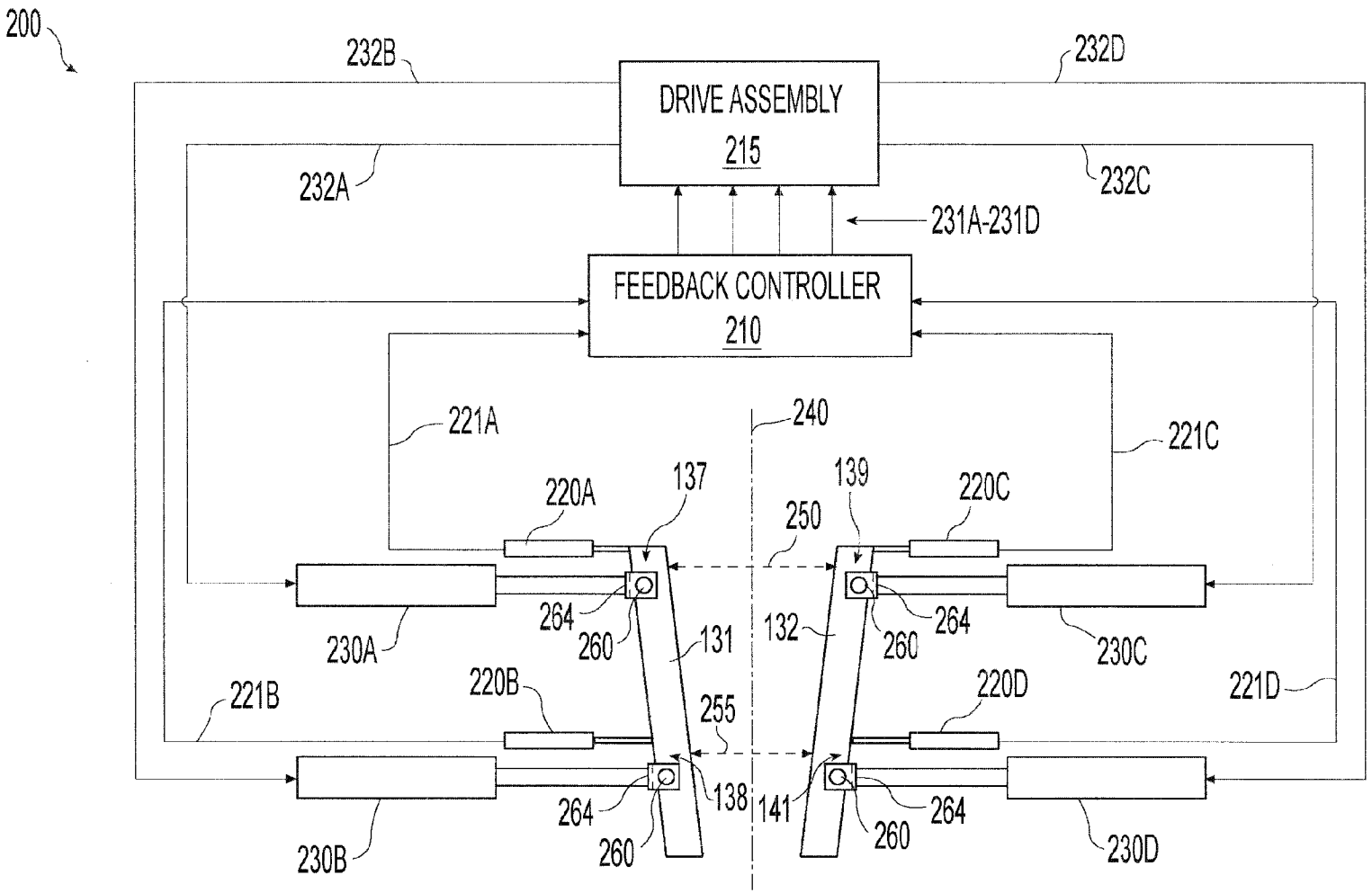
FIG. 2 is a schematic diagram of a caster mold feedback system showing the opposing moveable mold faces of the caster mold of FIG. 1, with a drive assembly and a feedback controller responsive to monitored position.

FIG. 1 is a schematic drawing illustrating a continuous slab caster 100 having a caster mold 130. The steel slab caster 100 includes a ladle 110 to provide molten steel 111 to a tundish 120 through a shroud 115. The tundish 120 directs the molten steel 111 to the caster mold 130 through a submerged entry nozzle (SEN) 125 connected to a bottom of the tundish 120. The caster mold 130 includes at least one set of laterally movable opposing mold faces, such as narrow mold faces 131, 132 shown in FIG. 1, and may have additional mold faces as desired to provide a desired cast shape. The caster mold 130 may have two opposing narrow mold faces 131, 132 as shown in FIG. 2, which are moveable, and broad mold faces 133 and 134 shown in FIG. 1, which may be fixed, or in certain applications, moveable. Alternately, the set of laterally movable opposing mold faces may have more than two opposing mold faces to provide a desired cast shape.

The set of opposing moveable mold faces 131, 132 are positioned laterally with respect to each other in a tapered configuration and movable at least in a lateral direction. The width 128 of the steel strand 136 leaving the caster mold 130 is substantially determined by the configuration of the caster mold faces 131, 132, 133, 134 at the mold exit 135. The mold 130 with a set of two opposing narrow mold faces 131, 132 and the opposing broad mold faces 133, 134 may form a substantially rectangular configuration, or any other desired configuration for the cast strand 136.

The cast strand 136 leaving the caster mold 130 enters a support roller assembly 140 adjacent the broad mold faces 133, 134, the metal continuing to solidify into a solid metal strand with the width dimension 128 substantially defined by the opposing mold faces. The support roller assembly 140 directs the strand 136 toward a cutting point 150 as the strand cools to a solid form. During casting, water (or some other cooling fluid) is circulated through the caster mold 130 to cool and solidify the surfaces of the cast strand 136. The strand 136 is cut across the width dimension at the cutting point 150, to provide a solid slab 160 having a predetermined length 165.

The caster mold 130 may oscillate to assist downward movement of the molten metal through the mold 130. Such oscillating is distinct and separate from the lateral movement of the opposing moveable mold faces 131, 132 in accordance with an embodiment of the present invention.

FIG. 2 shows the set of opposing mold faces of the caster mold 130 having the first mold face 131 and the second mold face 132 in a caster mold feedback system 200, interfacing with a drive assembly 215 and a feedback controller 210. Position sensors 220A-220D and drives, or actuators 230A-230D are positioned, in accordance with an embodiment, at locations 137 and 138 vertically spaced along moveable mold face 131 and locations 139 and 141 vertically spaced along moveable mold face 132, respectively. As shown in FIG. 2, one actuator 230A may be operatively connected to the first mold face 131 in the upper location 137 and another actuator 230B may be operatively connected to the first mold face 131 in the lower location 138. The actuator 230C may be operatively connected to the second mold face 132 in the upper location 139 and another actuator 230D may be operatively connected to the second mold face 132 in the lower location 141. The drives, or actuators 230A, 230B, 230C, 230D are independently movable and capable of positioning each end of each mold face 131, 132 relative to the centerline 240 of the mold to provide a mold width and mold taper as desired. The drives 230A-230D are capable of changing and maintaining, as desired, the lateral positions of the mold faces during casting at the locations 137, 138, 139, 141 adjacent the connections of sensors 220A-220D, respectively. The drives may be capable of moving the mold face at each location 137, 138, 139, 141 independently of the other locations 137, 138, 139, 141, and moving each mold face 131, 132, independently of the other mold face 131, 132.

When the caster mold 130 has a rectangular configuration, the two opposing moveable mold faces 131, 132 may be positioned substantially symmetrically about the centerline 240. The opposing moveable mold faces 131, 132 may be tapered at an angle, with first relative lateral distance 250 between the upper opposing locations 137 and 139 on the mold faces 131, 132 at the upper half of the mold faces, and a second relative lateral distance 255 between the other opposing locations 138 and 141 on the mold faces 131, 132 at the lower half of the mold faces. To form a taper, the first distance 250 is greater than the second distance 255. In accordance with an alternative embodiment, the mold faces 131, 132 are not symmetrically positioned with respect to each other.

The connections of the position sensors 220A-220D and drives 230A-230D to the mold faces may be by pivotable connections, such as pin and bushing, or any other suitable type, that permits lateral movement of the mold faces, and permits the measuring by sensors 220A-220D and drive capabilities by drives, or actuators 230A-230D, at the vertically spaced locations 137 and 138 on mold face 131 and at the vertically spaced locations 139 and 141 on mold face 132. As shown in FIG. 2, the actuators 230A-230D may have a clevis bracket 264 connected to the mold face by a pin 260 engaging at least a portion of the mold face and the clevis bracket 264.

The sensors 220A-220B are positioned and connected to the mold face 131 and the sensors 220C-220D are positioned and connected to the mold face 132, so as to detect a lateral change in the position of the moveable mold faces 131, 132. The mold taper may also be determined and controlled using the position sensors 220A-220D.

The position sensors 220A-220D may be linear sensors to monitor any linear lateral movement of the opposing moveable mold faces 131, 132 at the vertically spaced locations on each mold face. For example, the position sensors 220A-220D may comprise magnetostrictive position sensors in the form of temposonic transducers. In a magnetostrictive sensor, a current pulse is generated in the head of the device and sent traveling down a sensor tube. Downstream on the tube, a movable magnet having a magnetic field is used to indicate position. The current pulse interacts with the magnetic field and generates a strain pulse that progresses back up the sensor tube where it is detected at the head of the sensors. The time between launching the electronic pulse and receiving the returning strain pulse allows precise measurement of the magnet position. In accordance with an embodiment of the present invention, the position of the magnet accurately correlates to the lateral position of the mold face location. Other types of position sensors 220A-220D may be used as desired in accordance with various other embodiments. Alternately or in addition, the sensors 220A-220D may be integral parts of the respective actuators 230A-230D.

The drives 230A-230D are actuators capable of moving the mold face as desired. The drives 230A-230D may be actuators such as servo controlled drive screws, hydraulic drives with hydraulic cylinders, or other actuators, and driven by the drive assembly 215. Alternatively, for certain applications, the actuators 230A-230D may be pneumatic drives such as, for example, pneumatic cylinders that are driven by the drive assembly 215. Mechanical, electrical or other types of drives and drive assemblies may be used, in accordance with various other embodiments.

In operation, the position sensors 220A, 220B monitor the lateral position of the first mold face 131 at the two vertically spaced locations 137 and 138 on the mold face 131. Similarly, the position sensors 220C, 220D monitor the lateral position of the second mold face 132 at the two vertically spaced locations 139 and 141 on the mold face 132. The mold faces 131, 132 may tend to move due to pressure exerted on the mold faces 131, 132 by the molten steel inside the mold 130. The drives 230A-230D may be used to counter such exerted pressure by pushing on the mold faces to maintain a desired lateral configuration of the mold faces, such as to maintain the distances 250, 255 between the mold faces and the resultant taper. Similarly, the mold faces 131, 132 may move if the molten melt pulls away from the mold faces due to cooling and shrinkage. The drives 230A-230D may be used to counter such shrinkage by moving the mold faces to maintain the desired lateral configuration of the mold faces in contact with the surfaces of the cast strand 136.

Alternately or in addition, sensors may be provided to sense the forces against the movable mold faces 131, 132 or to determine the pressure exerted by the cast strand 136 against the moveable mold faces 131, 132, and selectively actuate the drives 230A-230D to maintain contact between the mold faces and the surfaces of the cast strand 136. A change in force against the movable mold faces 131, 132 may be correlated to a change in mold position or contact between the mold faces and the surfaces of the cast strand. The force sensors may be sensors such as, for example, load cells or strain gauges.

The position sensors 220A-220D are capable of sensing the location of each mold face 131, 132 as determined at each of the locations 137, 138, 139, 141, and capable of producing electrical signals 221A-221D indicative of each mold face position. The electrical signals 221A-221D from the position sensors 220A-220D indicative of each mold face position are fed to the feedback controller 210. The feedback controller 210 is capable of receiving the electrical signals indicative of the position of each mold face and causing the drives 230A-230D to move each end of each mold face independently to control the position and taper of each mold face.

The electrical signals 221A-221D from the position sensors 220A-220D each correlate to the lateral positions of the moveable mold face 131 at the locations 137 and 138, and of moveable mold face 132 at the locations 139 and 141. The raw data of sensor signals 221A-221D may be analog or digital signals. Within the feedback controller 210, the electrical signals 221A-221D from the position sensors 220A-220D are converted into digital data indicating the positions of the opposing mold faces 131, 132 at the vertically spaced locations. The controller 210 may compare the determined position data to desired position data, such as predetermined position set points stored in the memory of controller 210. If the determined position of the mold face is different than the predetermined position set points, the controller 201 may generate controller signals 231A-231D to the drive assembly 215. The drive assembly 215 commands the drives 230A-

230D, by the drive connections 232A-232D, such as electrical, hydraulic, or pneumatic drive lines, in response to the controller signals 231A-231D to move the opposing mold faces 131, 132 such that each opposing mold face maintains a desired position or geometry (that may be determined by position data such as distance set points and taper set points) with respect to each other as defined by the given position data stored within the controller 210, tending to maintain the mold faces in contact with the surfaces of the cast strand as it moves through the mold. The controller signals 231A-231D may be analog or digital signals, depending on the nature of the drive assembly 215.

In accordance with an embodiment, the feedback controller 210 includes instrumentation and control hardware and/or software as well as a processor. For example, the feedback controller 210 may be a programmable logic controller (PLC). The controller 210 is programmable such that the desired data may be modified as desired, and such that control parameters and/or algorithms, used to generate the controller signals 231A-231D in response to the sensor signals 221A-221D, may be modified. The drive assembly 215 is an interface between the controller 210 and the actuator 230, capable of causing the actuators to adjust lateral positions of the opposing mold faces responsive to the controller signals 231. The drive assembly 215 may be, for example, a hydraulic drive assembly. Alternately, the drive assembly 215 may be an electromechanical drive assembly. In yet another alternate, the actuators 230A-230D may be electromechanical actuators capable of receiving the controller signals 231A-231D from the feedback controller 210, omitting the drive assembly.

As an alternative, gearboxes and RAM motors having resolvers may be used instead of, for example, temposonic sensors and hydraulic drives. As the RAM motor turns, a resolver that is directly connected to the motor shaft sends a signal to the feedback controller. The signal is converted by the feedback controller into generated data for the corresponding location on the narrow face of the mold. However, such an alternative configuration may not be desired because such a configuration may be less accurate due to backlash in the gear boxes and other configuration inaccuracies such as, for example, inaccurate coupling from a gear box to a drive shaft.

The sensors 220A-220D may detect position through a range of zero to twelve inches with an accuracy of 0.0001% of full scale (e.g., 0.003 millimeters). Other ranges and accuracies may be used, in accordance with various other embodiments.

Force sensors 262A-262D may be provided capable of sensing forces exerted by the molten metal on at least one of the opposing mold faces in two vertically spaced locations along the monitored mold face during casting and producing electrical signals indicative of the forces exerted on the mold face. The force sensors 262A-262D may be load cells operatively positioned between the moveable mold faces 131, 132 and the actuators 230A-230D capable of controlling the position of the mold face at one or more vertically spaced locations during casting as desired.

Figure 4:
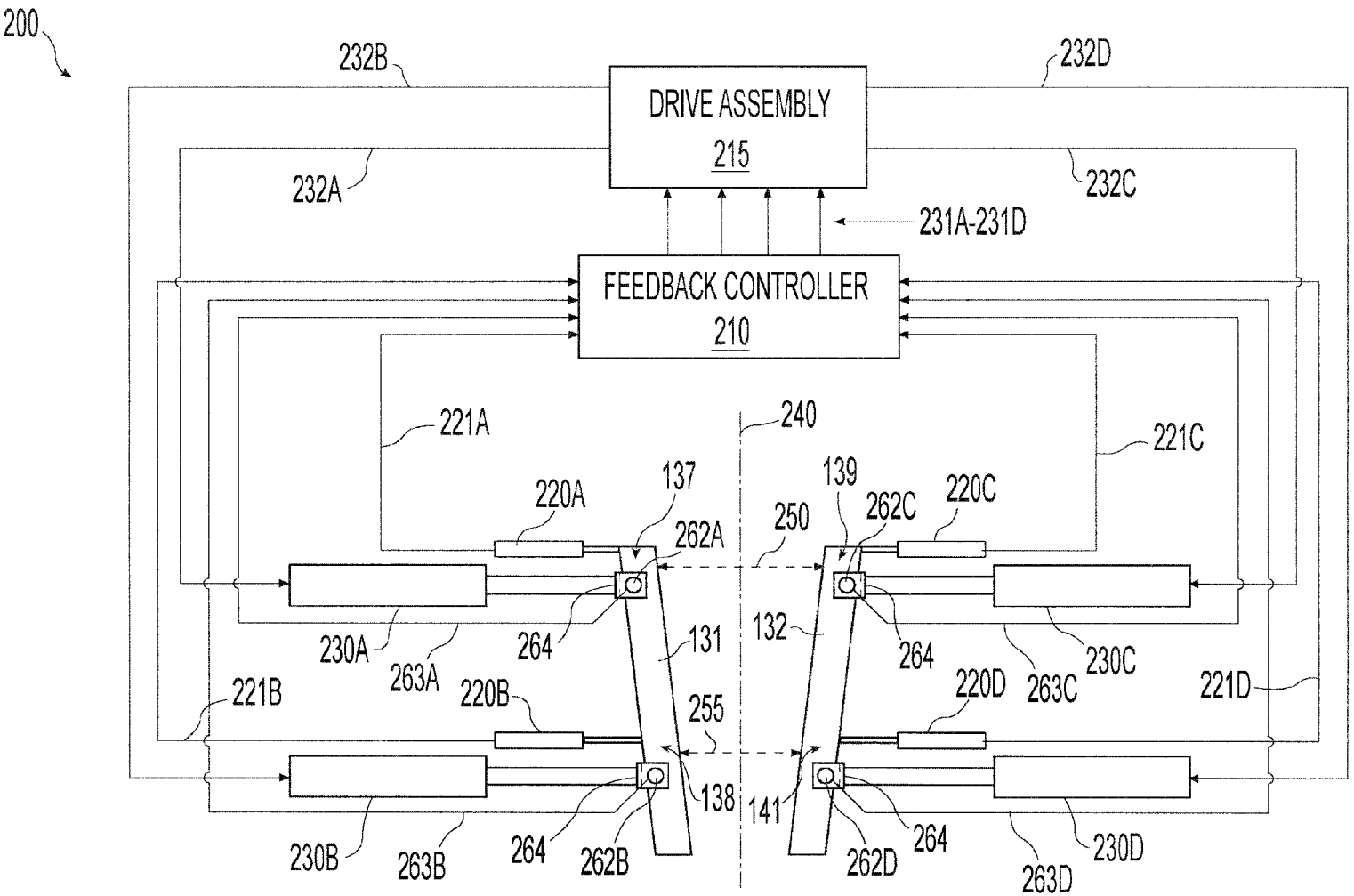
FIG. 4 is a schematic diagram of a caster mold feedback system showing the opposing moveable mold faces of the caster mold of FIG. 1, with a drive assembly and a feedback controller responsive to monitored forces.

As shown in FIG. 4, the force sensors 262A-262D may be positioned capable of sensing the forces exerted by the cast strand 136 as determined at each of the locations 137, 138, 139, 141, and capable of producing electrical signals 263A-263D indicative of the sensed forces exerted on the moveable mold faces. Alternately, the force sensors 262 may be positioned capable of sensing the forces exerted by the molten metal on each of the opposing mold faces in the set in one location along the mold faces during casting, such as the lower locations 138, 141 and producing electrical signals indicative of the forces exerted on the mold face.

The electrical signals 263A-263D from the force sensors 262A-262D indicative of the sensed forces are fed to the feedback controller 210. The feedback controller 210 is capable of receiving the electrical signals indicative of the sensed forces on each mold face and causing the actuators 230A-230D to move each end of each mold face independently to control the position and taper of each mold face responsive to the sensed forces on the mold faces 131, 132.

The electrical signals 263A, 263B from the force sensors 262A, 262B indicate the forces exerted by the cast strand 136 against the actuators 230A, 230B through the moveable mold face 131 at the locations 137 and 138, and the electrical signals 263C, 263D from the force sensors 262C, 262D indicate the forces exerted by the cast strand 136 against the actuators 230C, 230D through of moveable mold face 132 at the locations 139 and 141. The electrical signals 263A-263D may be analog or digital signals. Within the feedback controller 210, the electrical signals 263A-263D from the force sensors 262A-262D are converted into digital data indicating the force of the strand against the mold faces 131, 132 at the vertically spaced locations. The controller 210 may compare the sensed forces to a desired force stored in the memory of controller 210. The desired force may be a force set point, a force within a range of forces, or other desired result. If the sensed forces on the mold faces differ from the desired forces, the controller 210 may generate controller signals 231A-231D to the drive assembly 215 to maintain the desired force. Alternately or in addition, the controller 210 may monitor the sensed forces so as to detect a change in the force on the moveable mold faces 131, 132. If the change in forces on the mold faces differs from the desired result, the controller 210 may generate controller signals 231A-231D to the drive assembly 215 responsive to the change in forces. In yet another alternate, the controller 210 may monitor the sensed forces on the moveable mold faces 131, 132 and determine a difference between the sensed forces and a reference value or set point. The controller 210 may generate controller signals 231A-231D to the drive assembly 215 responsive to the determined difference.

Figure 5A:
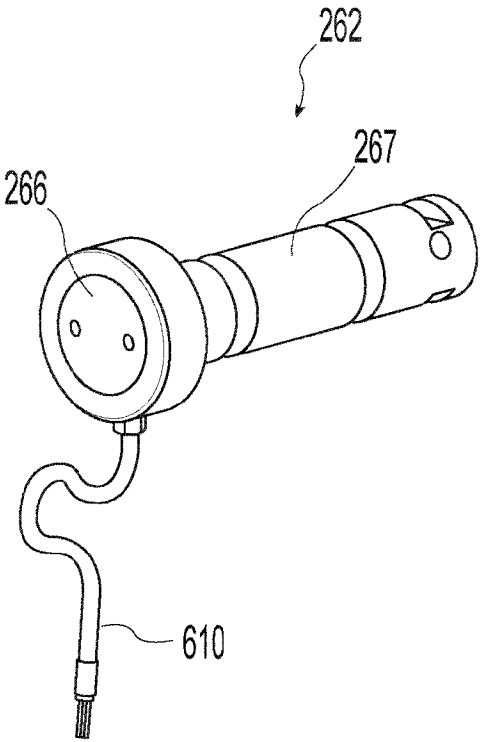
FIG. 5 is multiple views of a clevis pin load cell.
Figure 5B:
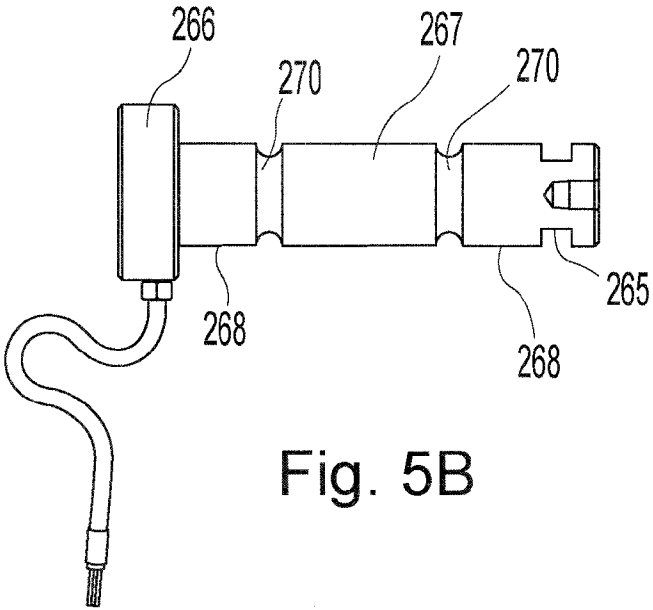
Figure 5C:
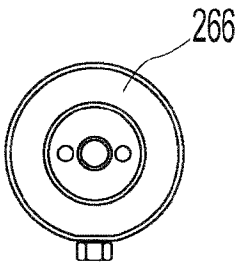

The force sensors 262A-262D may be configured as clevis pins, or load cell pins 262 as shown in FIGS. 4 and 5. The load cell pins 262A-262D may connect the actuators 230A-230D to the movable mold faces 131, 132 through the clevis brackets 264. In one configuration shown in FIGS. 5A through 5C, the load cell pins 262 may include a head portion 266, a center load section 267, two clevis support sections 268, and two instrumented portions between the center load section 267 and the clevis support sections 270. The load cell pins 262A-262D may have orienting features such as grooves 265 to orient the load cell pin according to the load direction. In one configuration, the sensors 262A-262D are capable of sensing forces between about 0 to about 15,000 pounds (0 to about 6,800 kilograms), and may have an accuracy of 0.24 pounds (0.11 kilograms). Alternately, the sensors 262A-262D are capable of sensing forces between about 0 to about 20,000 pounds (about 0 to about 9,100 kilograms), or in yet another alternate, between about 0 to about 25,000 pounds (0 to 11,300 kilograms). Other load ranges may be used as desired.

Figure 3:
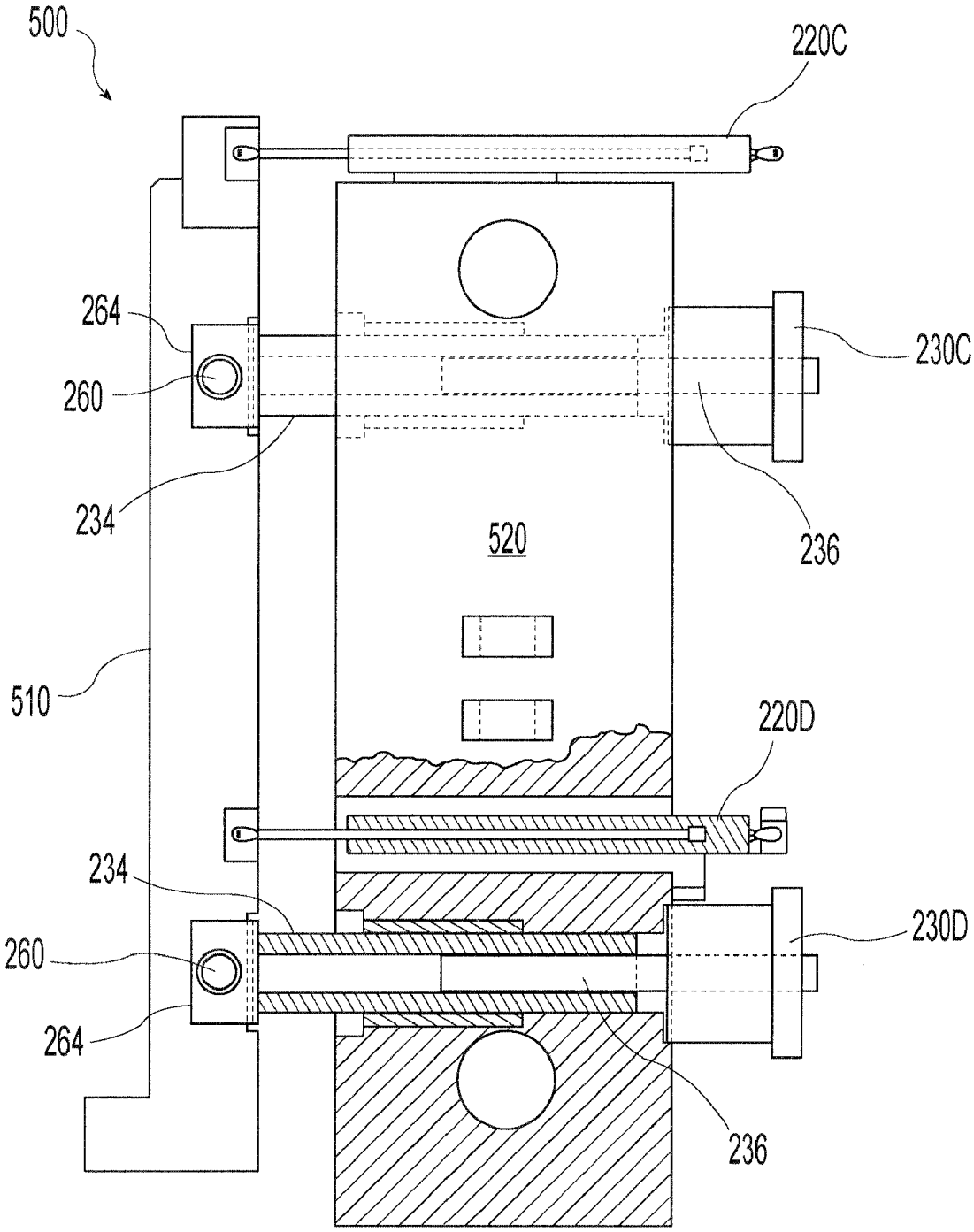
FIG. 3 is a schematic diagram illustrating one interface configuration to a movable mold face, in accordance with an embodiment of the present invention.

FIG. 3 is a schematic diagram illustrating an interface configuration 500 to a movable mold face, in accordance with an embodiment of the present disclosure. Instead of the actuators and sensors interfacing directly to a mold face, the actuators and sensors may instead interface to a support bracket that holds the mold face. As a result, a mold face may be more easily changed when necessary without having to affect the actuator and sensor connections.

The configuration 500 includes a narrow face support bracket 510 capable of supporting a mold face, and an endwall post 520. The drives, or actuators 230C, 230D may include thrust axles 234 actuated by drive screws, hydraulic cylinders, gears or other motion actuators, and connect to the support bracket 510 through or adjacent the endwall post 520. As shown in FIG. 3, the actuators 230 may include drive screws 236 to actuate the thrust axles 234. The drive 230C connects at an upper location on the support bracket 510 and the drive 230D connects at a lower portion on the support bracket 510. The endwall post 520 is fixed and the support bracket 510 is movable via the drives 230C, 230D. The position sensor 220D is also connected to the support bracket 510 through the endwall post 520 at a lower portion of the support bracket 510. The position sensor 220C is shown connecting to an upper portion of the support bracket 510 and is mounted along a top portion of the endwall post 520.

The connections of the sensors 220C and 220D and drives 230C and 230D to the support bracket 510 may be by pivotable connections (e.g., pin and bushing), or any other suitable type, that permits lateral movement of the support bracket, and permits the measuring by the sensors 220C and 220D and drive capabilities by drives 230C and 230D at the vertically spaced locations. The mold face such as mold face 132 (not shown in FIG. 3) attaches to the support bracket 510 and is fixed (i.e., is not movable) with respect to the support bracket 510. When the support bracket 510 is moved by the drives 230C and 230D, the mold face is, therefore, similarly moved. A similar configuration (not shown) may be positioned opposite the configuration 500 shown in FIG. 3 to accommodate the opposing mold face (e.g., mold face 131). The configuration of FIG. 3 may operate in a similar manner as described previously herein for FIG. 2, but with an intermediary support bracket 510 to hold the mold face and an endwall post 520 to secure and support the drives and sensors.

A first embodiment of a method of continuously casting steel slabs using the steel slab caster elements of FIG. 1 and FIG. 2 is disclosed. A casting mold is assembled for continuous casting of steel slabs with at least one set of laterally movable opposing mold faces. Molten metal is introduced into the casting mold having the movable opposing mold faces. The lateral positions of the opposing mold faces are monitored in at least two vertically spaced locations along at least one mold face of the opposing mold faces as casting proceeds. Electrical signals and/or data are generated indicating the lateral positions of the opposing mold faces at the vertically spaced locations in response to the monitoring. The opposed movable mold faces are adjusted in response to the generated data indicating the positions of the opposing mold faces at the vertically spaced locations.

Additionally, before casting begins, the position sensors 220A-220D and the force sensors 262A-262D may be used to set-up the mold. As an example, the caster mold feedback system 200 positions the mold faces to a desired position before casting begins, measured by the position sensors 220A-220D. Prior to introducing metal into the mold, the actuators 230A-230D may apply a desired force to the mold faces in a desired direction, measured by the force sensors 262A-262D. When molten steel is first introduced into the mold 130, the mold faces 131, 132 may initially tend to move outward, away from the desired lateral position, due to the forces exerted by the molten steel on the mold faces. The pre-loaded force may be determined to reduce the movement of the mold face upon start-up of casting. The position sensors 220A-220D immediately sense any initial movement of the mold faces 131, 132 and the caster mold feedback system 200 automatically reacts to move and maintain the mold faces in position by the drives 230A-230D.

As the molten steel cools and solidifies at the mold faces 131 and 132, due to circulated water cooling, the surfaces of the solidifying molten melt may tend to move away from the mold faces 131 and 132, and cause shrinkage, of the molten metal as thermal energy transfers from the molten steel to the mold faces. Such shrinkage can cause the forces on the mold faces 131 and 132 by the molten melt to change, causing the mold faces to tend to move inward, for example, toward the molten steel. Again, in such a case, any initial change in position of the mold faces will be immediately sensed and the system 200 may automatically react to maintain the desired position of the mold faces 131 and 132 relative to the surfaces of the cast strand 136. The taper of the mold faces 131 and 132 may also be adjusted to account for the shrinkage of the molten steel, allowing the surfaces of the cast strand 136 to maintain contact with the mold faces as the molten steel moves downward through the mold 130. The sensors 220A-220D and actuators 230A-230D allow adjustments to be made independently, as desired, at each of the locations 137, 138, 139 or 141 to maintain contact between the mold faces and the surface of the cast strand. During tailout of the cast strand from the mold at the end of a casting run, the mold faces tend to move inward toward each other. The caster mold feedback system 200 may be used to compensate for such movement of the mold faces during a tailout condition.

The forces exerted by the molten metal on at least one of the opposing mold faces may be monitored in two vertically spaced locations along the monitored mold face during casting, producing electrical signals indicative of the forces exerted on the mold face. The opposing movable mold faces may be controlled in response to the electrical signals indicative of the forces exerted on the mold face. Alternately, the forces exerted by the molten metal on each of the opposing movable mold faces may be monitored in at least one location along the monitored mold face, and the movable mold faces may be controlled in response to the forces exerted on the mold face at the monitored location.

The method may further include directing the molten steel to exit the mold 130 into a support roller assembly 140 adjacent broad mold faces 133 and 134, such that the cast strand 136 continues to harden into a solid metal strand having a width dimension 128 substantially defined by the exit from the opposing moveable mold faces 131 and 132. Once the cast strand 136 is solidified, the cast strand 136 may be cut across the width dimension to provide a solid steel slab 160 having a predetermined length 165.

Therefore, the caster mold feedback system 200 adapts to changes in forces on the mold faces 131 and 132 in real time to maintain the desired configuration of the mold faces. Such an adaptation allows for a stable steel strand to be produced in the steel slab caster 100, resulting in stable steel slabs 160.

In yet another alternate method of continuously casting steel slabs using the steel slab caster elements of FIG. 1 and FIG. 2, at least one set of opposing movable mold faces of a slab caster mold is laterally positioned with respect to each other in a desired lateral configuration. Molten steel is introduced into the slab caster mold having the at least one set of opposing moveable mold faces. The lateral positions of the opposing moveable mold faces and/or forces exerted by the molten steel against the mold faces are monitored in at least two vertically spaced locations on each movable mold face of the opposing mold faces during casting. Electrical signals and/or data are generated in response to the monitoring. The opposed movable mold faces are adjusted in response to the generated data at the vertically spaced locations.

The caster mold feedback system 200 is a dynamic system capable of maintaining the positions of at least two opposing moveable mold faces with respect to one or more set points, which may correspond to a reference such as a predefined centerline 240 or other reference location. The set points may be a desired distance, force, taper angle, or other set points as desired. During a casting process, the desired configuration of the opposing mold faces may be controlled by an operator, such that the distances 250 and 255 are adjusted in order to start and change casting steel strand with new characteristics (e.g., a narrower or wider width). For example, the mold 130 may be configured such that the desired width 128 of the strand 136 can be adjusted between 36 inches and 65 inches. Such flexibility allows quality product to be maintained at all desired widths. Furthermore, casting can automatically transition from a first set of casting parameters to a second set of casting parameters without having to interrupt the production of the cast strand exiting the mold. The lateral positions of the opposing mold faces may be adjusted in response to the generated data to maintain a distance set point or a taper set point, or both, between the opposing mold faces, or to maintain a predefined lateral configuration as casting proceeds. The adjusting of the lateral position of the opposing mold faces may be performed automatically.

In summary, a steel slab caster, having a mold with movable opposing mold faces, and methods of using the steel slab caster for casting steel slabs are disclosed. A caster mold feedback system allows dynamic control of the positions of the opposing moveable mold faces during the casting process. Such dynamic control of the opposing mold faces allows for better quality control of the steel strand out of the mold and, therefore, an increase in prime tons of steel produced.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

What is claimed is:

1. A method of continuously casting steel slabs comprising:

assembling a casting mold for continuous casting of steel slabs comprising a set of laterally movable opposing mold faces;

introducing molten metal into the casting mold;

monitoring the forces exerted by the molten metal on at least one of the opposing mold faces in two vertically spaced locations along the monitored mold face during casting by at least one load cell in the form of a clevis pin operatively connecting the monitored mold face and an actuator, and producing electrical signals indicative of the forces exerted on the mold face;

controlling the position of the monitored mold face at the vertically spaced locations during casting responsive to the electrical signals indicative of the forces exerted on the mold face.

2. The method of continuously casting steel slabs as claimed in claim 1 further comprising:

monitoring the forces on each of the opposing mold faces in the set in two vertically spaced locations along the mold faces during casting; and controlling the position of each mold face at the vertically spaced locations during casting responsive to the electrical signals indicative of the forces exerted on the mold face.

3. The method of continuously casting steel slabs as claimed in claim 1 where controlling the position of the monitored mold face comprises adjusting lateral positions of the opposing mold faces during casting to maintain a desired force exerted on the mold face.

4. The method of continuously casting steel slabs as claimed in claim 1 where controlling the position is accomplished using the actuator selected from the group consisting of hydraulic drives, electrical drives, and mechanical drives and capable of moving the mold face at the vertically spaced locations during casting as desired.

5. The method of continuously casting steel slabs as claimed in claim 1 where controlling the position of the monitored mold face is performed automatically or manually.

6. The method of continuously casting steel slabs as claimed in claim 1, where the load cells are integrated with actuators capable of controlling the position of the mold face during casting as desired.

7. The method of continuously casting steel slabs as claimed in claim 1 further comprising:

monitoring the lateral position of at least one of the opposing mold faces in two vertically spaced locations along the monitored mold face during casting and producing electrical signals indicative of the lateral position of the mold face in the vertically spaced locations;

controlling the position of the monitored mold face at the vertically spaced locations responsive to the electrical signals indicative of the lateral position of the mold face in the vertically spaced locations.

8. The method of continuously casting steel slabs as claimed in claim 7 where controlling the position of the monitored mold face comprises adjusting lateral positions of the opposing mold faces responsive to the electrical signals indicative of the lateral position of the mold face in the vertically spaced locations during casting to maintain at least one of a distance set point and a taper set point between the opposing mold faces.

9. The method of continuously casting steel slabs as claimed in claim 8 where the adjusting is accomplished using at least one actuator selected from the group consisting of hydraulic drives, electrical drives, and mechanical drives and capable of moving the mold face at the vertically spaced locations during casting as desired.

10. The method of continuously casting steel slabs as claimed in claim 7 where the monitoring is accomplished using at least one sensor selected from the group consisting of temposonic transducers, magnetostrictive position sensors, and linear position sensors.

11. The method of continuously casting steel slabs as claimed in claim 1 further comprising: directing the metal exiting the mold into a support roller assembly, the metal continuing to solidify into a solid metal strand having a width dimension substantially defined by the opposing mold faces.

12. The method of continuously casting steel slabs as claimed in claim 11 further comprising: cutting the solid metal strand across the width dimension to provide a solid steel slab having a predetermined length.

13. A method of continuously casting steel slabs comprising:

positioning at least one set of laterally movable opposing mold faces of a casting mold with respect to each other in a predefined lateral configuration;

introducing molten metal into the casting mold;

monitoring the forces exerted by the molten metal on the opposing mold faces in at least one location along the mold faces during casting by at least one load cell in the form of a clevis pin operatively connecting the monitored mold face and an actuator, and producing electrical signals indicative of the forces exerted on the mold face;

controlling the position of each mold face during casting responsive to the electrical signals indicative of the forces exerted on the mold face.

14. The method of continuously casting steel slabs as claimed in claim 13 further comprising:

monitoring the lateral position of at least one of the opposing mold faces in two vertically spaced locations along the monitored mold face during casting and producing electrical signals indicative of the lateral position of the mold face in the vertically spaced locations; and controlling the position of the monitored mold face at the vertically spaced locations responsive to the electrical signals indicative of the lateral position of the mold face in the vertically spaced locations.

15. The method of continuously casting steel slabs as claimed in claim 14 further comprising:

automatically adjusting at least one of the vertically spaced locations of the mold faces during casting to maintain the predefined lateral configuration.

16. The method of continuously casting steel slabs as claimed in claim 15 where the predefined lateral configuration includes at least one of a distance set point and a taper set point between the opposing mold faces.

17. The method of continuously casting steel slabs as claimed in claim 15 where the adjusting is accomplished using the actuator selected from the group consisting of hydraulic drives, electrical drives, and mechanical drives and capable of moving the mold face at the vertically spaced locations during casting as desired.

18. The method of claim 14 where monitoring the lateral position is accomplished using at least one sensor selected from the group consisting of temposonic transducers, magnetostrictive position sensors, and linear position sensors.

19. The method of continuously casting steel slabs as claimed in claim 13 further comprising:

automatically adjusting at least one of the vertically spaced locations of the mold faces during casting to maintain a desired force exerted on the mold faces.

20. The method of continuously casting steel slabs as claimed in claim 19 where the adjusting is accomplished using at least one actuator selected from the group consisting of hydraulic drives, electrical drives, and mechanical drives and capable of moving the mold face at the vertically spaced locations during casting as desired.

* * * * *